US006843826B2

(12) United States Patent
Stouvenot et al.

(10) Patent No.: US 6,843,826 B2
(45) Date of Patent: Jan. 18, 2005

(54) VACUUM TREATMENT OF MOLTEN METAL WITH SIMULTANEOUS STIRRING BY HELIUM INJECTION

(75) Inventors: François Stouvenot, Labry (FR); Marc Burty, Metz (FR); Jean-François Domgin, Sommerviller (FR); Pascal Gardin, Metz (FR); Dominique Viale, Metz (FR); Raymond Reitz, Terville (FR); Frédéric Leclercq, Metz (FR)

(73) Assignee: Usinor, Puteaux (FR)

( * ) Notice: Subject to any disclaimer, the term of this patent is extended or adjusted under 35 U.S.C. 154(b) by 135 days.

(21) Appl. No.: 10/221,957

(22) PCT Filed: Mar. 27, 2001

(86) PCT No.: PCT/FR01/00918

§ 371 (c)(1),
(2), (4) Date: Dec. 11, 2002

(87) PCT Pub. No.: WO01/73140

PCT Pub. Date: Oct. 4, 2001

(65) Prior Publication Data

US 2004/0035248 A1 Feb. 26, 2004

(30) Foreign Application Priority Data

Mar. 29, 2000 (FR) ..... 00 03966

(51) Int. Cl.[7] ..... C21C 7/10
(52) U.S. Cl. ..... 75/414; 75/512; 266/208

(58) Field of Search ..... 75/414, 512; 266/208

(56) References Cited

U.S. PATENT DOCUMENTS

| | | | | |
|---|---|---|---|---|
| 3,169,058 A | | 2/1965 | Nelson | |
| 3,982,927 A | | 9/1976 | Saleil | |
| 4,071,356 A | | 1/1978 | Yamamoto et al. | |
| 4,518,421 A | * | 5/1985 | Foulard et al. | 75/414 |
| 6,162,388 A | * | 12/2000 | Huin et al. | 266/209 |

FOREIGN PATENT DOCUMENTS

| | | |
|---|---|---|
| GB | 938221 | 10/1963 |

OTHER PUBLICATIONS

Database WPI Section Ch, Week 198046, Derwent Publications Ltd., London, GB, AN 1980–81344C, XP002170610, & JP 55 125220, Sep. 26, 1980.

* cited by examiner

*Primary Examiner*—Melvyn Andrews
(74) *Attorney, Agent, or Firm*—Sughrue Mion, PLLC

(57) ABSTRACT

A vacuum treatment of cast metal in liquid form employing the steps of: introducing the cast metal in liquid form into a metallurgic ladle; filling the ladle until a guard height ranging between 0.4 and 0.6 m is reached; and treating the metal while bringing the atmosphere above the ladle under vacuum, and simultaneously stirring the cast metal by injecting helium into the base of the ladle during part of or the whole treatment.

8 Claims, 1 Drawing Sheet

VACUUM TREATMENT OF MOLTEN METAL WITH SIMULTANEOUS STIRRING BY HELIUM INJECTION

BACKGROUND OF THE INVENTION

The invention relates to a process for the vacuum treatment of molten metal in liquid form, such as steel for example.

SUMMARY OF THE INVENTION

On leaving the converter, rimmed steel must generally undergo various complementary metallurgical operations which are carried out in a ladle equipped with a vacuum installation. These operations generally consist of deoxidation of the liquid metal and then setting of its grade and temperature before this metal is solidified by continuous casting or casting into a mold. For some applications requiring low contents of dissolved gases (hydrogen and nitrogen) and/or of carbon, a treatment called degassing is carried out, the effectiveness of which is greatly improved by reducing the pressure of the atmosphere in contact with the liquid metal.

For decarburization treatment for example, when the suitable conditions for steel composition and for pressure above the bath are combined, decarburization of the steel takes place by the oxygen combining with the carbon dissolved in the metal to form gaseous carbon monoxide. This decarburization is assisted by stirring the liquid metal, said stirring being carried out for example by injecting an inert gas, usually argon, into the liquid steel from the bottom of the ladle.

Effective stirring is essential for decarburization, such as degassing, to be carried out correctly since the partial vacuum created above the bath affects only a small layer of the steel in the upper part of the bath. It is therefore essential for this reaction region to be permanently supplied with the underlying steel in order to ensure that the desired overall performance is achieved. The same applies to dehydrogenation or denitriding treatments.

However, stirring the liquid steel generally creates agitation of the surface of the slag-covered steel. This agitation, further exacerbated when the ladle is put under vacuum, may cause splashes of liquid steel and slag against the walls of the ladle, the cover or the vessel in which the ladle to be treated is placed. To limit such splashes and prevent the liquid metal and the supernatant slag from getting out, the operator must maintain a safety distance between the surface of the liquid steel at rest and the upper rim of the ladle, a distance called the safety height. Respecting this safety height therefore means that the level to which the metallurgical ladle is filled has to be limited to a lower value than its nominal value.

Otherwise, the operator will be forced to limit the stirring rate, or even omit this stirring in order to limit the surface agitation, which may lead directly to a downgrading of the steel obtained.

Thus, the object of the invention is to provide a process for the in-ladle vacuum treatment of larger quantities of liquid metal, while still guaranteeing that this treatment is carried out correctly.

For this purpose, the subject of the invention is a process for the vacuum treatment of a molten metal in liquid form, comprising the steps consisting in:

- introducing the molten metal in liquid form into a metallurgical ladle, filling said ladle until achieving a safety height of between 0.4 and 0.6 m;

- treating the metal by putting the atmosphere above said ladle under a partial vacuum and by simultaneously stirring the molten metal by injecting helium into the bottom of said ladle during part of the treatment or throughout the latter.

The invention may furthermore have the following features:

- the treatment is a decarburization treatment applied to steel;
- the treated metal is steel which has a carbon content of less than 60 ppm after having been decarburized;
- the treatment is a dehydrogenation treatment applied to steel;
- the treatment is a denitriding treatment applied to steel;
- the flow rate of injected helium is greater than or equal to 1.875 Sl/min per tonne of molten metal;
- the helium injection takes place through the wall of the ladle which is provided with gas injectors fitted beneath the level of the liquid metal; and
- the helium injection takes place through the bottom of the ladle which is provided with gas injectors in its bottom.

DETAILED DESCRIPTION OF THE INVENTION

Figure 1:
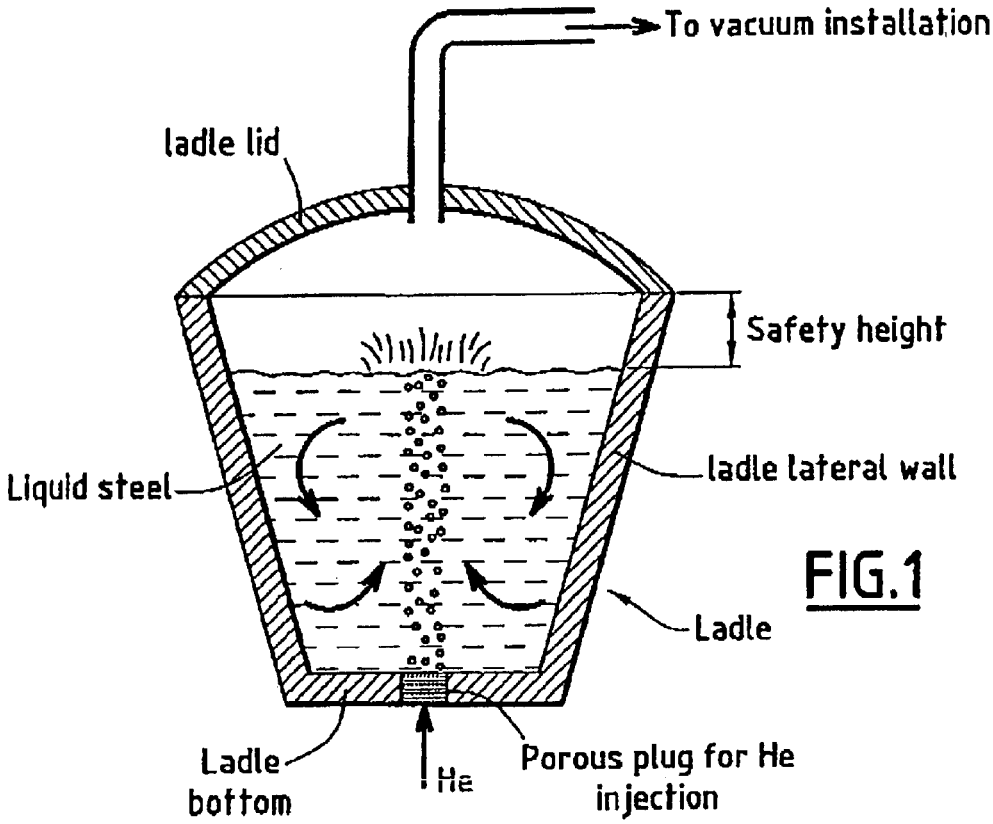
FIG. 1 is a schematic diagram of a ladle having a gas injector (a refractory porous plug) in the ladle bottom.

As will have been understood, the invention consists in coupling the use of helium as stirring gas with the establishment of a lower safety height than normally used in practice.

This is because the present inventors have found that by using as stirring gas helium instead of argon or nitrogen, the liquid-steel surface agitation phenomena are very substantially reduced, thus making it possible to reduce the safety height and consequently to increase the extent to which the ladle is filled with liquid metal, hence a substantial increase in productivity.

An example of a process in the prior art and an example of how the invention is implemented in the case of the decarburization of liquid steel in a vacuum tank will now be described.

In the prior art, the vacuum treatment of a molten metal, such as steel, is carried out by first filling a metallurgical ladle until achieving a safety height of generally between 0.6 and 1 m, and then by creating a vacuum in the ladle, into which argon or nitrogen is simultaneously injected in order to stir the steel.

The ladle used in this example is substantially cylindrical in shape, with a total height of about 4.4 meters and a maximum capacity for 300 tonnes of steel. By setting the safety height to a value of 0.8 m, 240 tonnes may generally be treated per ladle. The gas injectors used consist of three porous plugs inserted into the bottom of the ladle. These porous plugs are each designed to support a maximum gas flow rate of 600 Sl/min (1 Sl=1 liter measured under standard temperature and pressure conditions).

When the ladle containing the liquid steel is placed in a chamber in which a partial vacuum is gradually created, this produces an emission of CO in the upper layers of the metal in the ladle, with a pressure level in the chamber corresponding to the CO pressure in equilibrium with the activities of the carbon and oxygen which are dissolved in the metal. The rate of this CO emission by spontaneous boiling owing to the effect of the partial vacuum is relatively high and causes the level of metal in the ladle to rise and metal splashes to form. Because of this CO emission, the stirring rate must be limited for each of the porous plugs to typically 50 to 80 Sl/min, for an initial safety height of 0.8 m, i.e. a total flow rate of injected inert gas of 0.625 to 1 Sl/t/min.

When the rate of CO emission drops as a result of the decrease in the carbon content of the metal, the flow rate of stirring gas is generally increased, this taking place during the so-called low-pressure phase, for which the pressure in the chamber containing the ladle is less than 10 mbar, typically of the order of 1 mbar. The flow rate of injected gas per porous element is typically 200 Sl/min, i.e. a total flow rate of injected argon or nitrogen into the ladle of 2.5 Sl/min per tonne of steel.

Under these conditions, the degree of agitation of the liquid steel surface and the rate of steel splashes generated owing to the combined effect of the CO boiling and of the stirring gas remain acceptable throughout the treatment.

If the safety height were to be reduced to a value of between 0.4 and 0.6 m, while injecting argon or nitrogen, it would be essential to greatly reduce the injection flow rate of inert gas to flow rates of less than those indicated for a standard safety height, which would result, for the same vacuum treatment time, in inferior decarburization performance. In the case of steel decarburization, this would lead to a steel insufficiently decarburized and therefore unsuitable for the intended use.

The process according to the invention was used for the vacuum treatment of 240 t of liquid steel in a ladle similar to that of the prior art example that has just been described, while injecting helium under the same conditions as above. The injected helium flow rates were about 150 Sl/min for each of the porous plugs during the vacuum-creating phase, i.e. 1.875 Sl/t/min in total. These flow rates were then increased to 200 Sl/min for each of the plugs when the ladle was under a vacuum of 1 mbar or less, i.e. a total flow rate of 2.5 Sl/t/min.

Surprisingly, it has been found that agitation of the liquid steel surface is reduced. The splashes of liquid steel against the walls of the ladle are consequently also reduced, thereby allowing the ladle to be filled so as to leave a safety height of between 0.4 and 0.6 m. A further 20 tonnes of liquid steel can therefore be treated in a single operation, with the same metallurgical performance and the same safety conditions as with argon or nitrogen injection, hence an increase in productivity of about 10%.

Furthermore, the treatment may be taken to its completion during the available time period, thereby making it possible to obtain a steel conforming to the intended characteristics.

Figure 2:
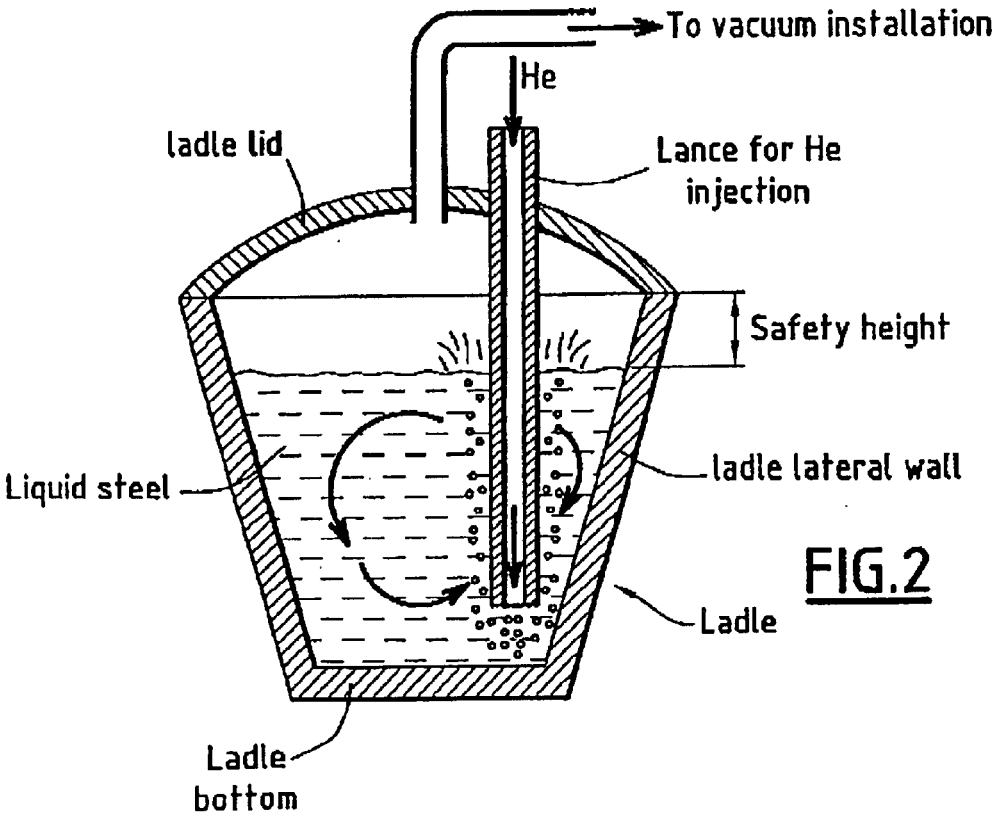
FIG. 2 is a schematic diagram of a ladle and a lance which is immersed in liquid steel, and which injects the gas into a vicinity of the ladle bottom.

Of course, the gas may be injected into the liquid metal by any type of injector such as, in particular, at least one porous plug inserted in the bottom of the ladle (as shown in FIG. 1), or at least one lance immersed directly in the liquid metal (as shown in FIG. 2).

The process according to the invention is more particularly suitable for carrying out vacuum decarburization treatments on steels, for which it is desirable to obtain a final carbon content of less than 60 ppm, but it could be used in any vacuum metallurgical process that requires stirring and entails a safety height to be met.

What is claimed is:

1. A process for the vacuum treatment of molten metal in liquid form, comprising the steps of:

introducing the molten metal in liquid form into a metallurgical ladle, filling said ladle until achieving a safety height of between 0.4 and 0.6 m, said safety height being defined as the distance between the surface of the molten metal, at rest in the ladle, and an upper rim of the ladle; and treating the metal by putting the atmosphere above said ladle under a partial vacuum and by simultaneously stirring the molten metal by injecting helium into the vicinity of the bottom of said ladle during part of the treatment or throughout the latter.

2. The process as claimed in claim 1, characterized in that said treatment is a decarburization treatment applied to steel.

3. The process as claimed in claim 2, characterized in that the steel has a carbon content of less than 60 ppm after having been decarburized.

4. The process as claimed in claim 1, characterized in that the said treatment is a dehydrogenation treatment applied to steel.

5. The process as claimed in claim 1, characterized in that the said treatment is a denitriding treatment applied to steel.

6. The process as claimed in claim 1, characterized in that the flow rate of injected helium is greater than or equal to 1.875 Sl/min per tonne of molten metal.

7. The process as claimed in claim 1, characterized in that the helium injection takes place through a ladle wall which is provided with at least one gas injector fitted beneath the surface of the molten metal.

8. The process as claimed in claim 7, characterized in that the said helium injection takes place through the ladle bottom wall which is provided with said at least one gas injector.

* * * * *